US009821180B2

(12) United States Patent
Heck

(10) Patent No.: US 9,821,180 B2
(45) Date of Patent: Nov. 21, 2017

(54) FIRE SUPPRESSANT SYSTEMS

(71) Applicant: Kenneth Wendlin Heck, Olds (CA)

(72) Inventor: Kenneth Wendlin Heck, Olds (CA)

( * ) Notice: Subject to any disclaimer, the term of this patent is extended or adjusted under 35 U.S.C. 154(b) by 0 days.

(21) Appl. No.: 15/094,680

(22) Filed: Apr. 8, 2016

(65) Prior Publication Data

US 2017/0291053 A1 Oct. 12, 2017

(51) Int. Cl.

| | |
|---|---|
| ***A62C 27/00*** | (2006.01) |
| ***A62C 5/00*** | (2006.01) |
| ***A62C 31/24*** | (2006.01) |
| ***F22B 37/64*** | (2006.01) |

(52) U.S. Cl.

CPC ..... *A62C 31/24* (2013.01); *A62C 5/00* (2013.01); *A62C 27/00* (2013.01); *F22B 37/64* (2013.01)

(58) Field of Classification Search

CPC ..... A62C 31/24; A62C 5/00; A62C 27/00; F22B 37/64

USPC ..... 169/46; 239/271–272

See application file for complete search history.

(56) References Cited

U.S. PATENT DOCUMENTS

| | | | | | |
|---|---|---|---|---|---|
| 1,106,679 | A * | 8/1914 | Randall | B05B 1/14 | 169/37 |
| 3,497,012 | A * | 2/1970 | Williamson | A62C 99/009 | 169/11 |
| 4,147,216 | A * | 4/1979 | Schnepfe, Jr. | A62C 31/22 | 166/297 |
| 4,417,626 | A * | 11/1983 | Hansen | A62C 37/09 | 169/37 |
| 4,930,579 | A * | 6/1990 | George | A62C 3/00 | 169/54 |
| 4,986,366 | A * | 1/1991 | O'Connell | A62C 35/00 | 137/68.13 |
| 5,678,637 | A * | 10/1997 | O'Connell | A62C 31/02 | 169/10 |
| 6,543,393 | B1 | 4/2003 | Cunningham | | |
| 2006/0196681 | A1 | 9/2006 | Adiga | | |
| 2014/0076589 | A1 | 3/2014 | Wang | | |

FOREIGN PATENT DOCUMENTS

| | | |
|---|---|---|
| CA | 1317852 | 5/1993 |
| CA | 2162392 | 11/1994 |
| CA | 2194525 | 7/1997 |
| CA | 2165320 | 11/2005 |
| CN | 1836756 | 9/2006 |
| CN | 101554520 | 10/2009 |
| CN | 201848043 | 6/2011 |
| CN | 204134082 | 2/2015 |
| DE | 10050181 | 4/2002 |

* cited by examiner

*Primary Examiner* — Chee-Chong Lee

(74) *Attorney, Agent, or Firm* — Integrity Patent Group, PLC; Edwin Wold

(57) ABSTRACT

A fire suppressant system is a device that uses steam/super-heated water to suppress and put out fires rather than the traditional water method. The invention uses steam/super-heated water under high pressure to blow out and suppress the fire. The wet pressurized steam/super-heated water "blows out" the fire and the pressure removes (displaces) the oxygen and spark needed for the fire to continue burning. The wet steam/super-heated water works much like water to suppress and put out the fire but the additional benefits of the pressure help to reduce the fuel (air and spark) for the fire as well.

20 Claims, 5 Drawing Sheets

FIRE SUPPRESSANT SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of fire extinguishers and more specifically relates to a fire suppressant system.

2. Description of Related Art

Fire is the rapid oxidation of a material in the exothermic chemical process of combustion, releasing heat, light, and various reaction products. Slower oxidative processes like rusting or digestion are not included by this definition. Fire is hot because conversion of the weak double bond in molecular oxygen, O2, to the stronger bonds in the combustion products carbon dioxide and water releases energy (418 kJ per 32 g of O2); the bond energies of the fuel play only a minor role here. At a certain point in the combustion reaction, called the ignition point, flames are produced. The flame is the visible portion of the fire. Flames consist primarily of carbon dioxide, water vapor, oxygen and nitrogen. If hot enough, the gases may become ionized to produce plasma. Depending on the substances alight, and any impurities outside, the color of the flame and the fire's intensity will be different.

Fire in its most common form can result in conflagration, which has the potential to cause physical damage through burning. Fire is an important process that affects ecological systems around the globe. The positive effects of fire include stimulating growth and maintaining various ecological systems. The negative effects of fire include hazard to life and property, atmospheric pollution, and water contamination. This is not desirable.

Several attempts have been made to solve the above-mentioned problems such as those found in U.S. Pub. No. US 2014/0076589 to Shih-Cheng Wang; US 2006/0196681 to Kayyani Adiga, U.S. Pat. No. 6,543,393 to Kenneth G. Cunningham, and Foreign Pat. No. DE 10050181 to Robert C. Lyne, Jr.; CA 2165320 to Lyle D. Galbraith; CA 2162392 to Michael O'connell; CN 101554520 to Hu Yonghua; CN 1836756 to Yang Lijun.; CN 201848043 to Pang Chung.; CN 204134082 to Ginger Come; CA 1317852 to Michael Oliver O'connell; and CA 2194525 to Matthew Alan Cox. This art is representative of fire extinguishing means. However, none of the above inventions and patents, taken either singly or in combination, is seen to describe the invention as claimed.

Preferably, a fire suppressant system should provide efficient means for suppressing fires and, yet would operate reliably and be manufactured at a modest expense. Thus, a need exists for a reliable fire suppressant system to use steam/super-heated water to suppress and put out fires rather than the traditional water and/or foam method and avoid the above-mentioned problems.

BRIEF SUMMARY OF THE INVENTION

In view of the foregoing disadvantages inherent in the known fire extinguisher art, the present invention provides a novel fire suppressant system. The general purpose of the present invention, which will be described subsequently in greater detail is to provide a reliable means for suppressing fires.

A fire suppressant system is disclosed herein, in a preferred embodiment, comprising: a fire suppressant assembly having at least one water storage compartment, at least one fuel storage compartment, at least one once through boiler, at least one hydraulic pump, at least one generator, at least one water pump, at least one hose reel, and a telescoping steam boom. Fire suppressant system comprises said fire suppressant assembly. The fire suppressant system is mounted to a vehicle frame. The fire suppressant assembly comprises in functional combination the at least one water storage compartment, the at least one fuel storage compartment, the at least one once through boiler, the at least one hydraulic pump, the at least one generator, the at least one water pump, the at least one hose reel, and the telescoping steam boom.

The at least one pump takes suction from the water storage tank and delivers high pressure water to the once through boiler where the water is super heated and delivered to the manifold. The at least one water storage compartment has a capacity of 2000 gallons of the water in preferred embodiments. The at least one water storage compartment is able to hold at least one fire-suppressant liquid.

The at least one fuel storage compartment has a capacity of 1200 gallons of the fuel to provide sustained fire-fighting ability over a duration in preferred embodiments. The vehicle is movable between locations. The at least one once through boiler heats water delivered from an inner volume of the at least one water storage compartment. The at least one the once through boiler superheats the high pressure water delivered from the high pressure at least one water pump to the steam distribution manifold. The at least one water pump pumps the steam/super-heated water from the at least one once through boiler through the telescoping steam boom, the water used to suppress and extinguish a fire. The water is super-heated under high-pressure. The telescoping steam boom is double-walled.

The telescoping steam boom is double-walled to be fire resistant. The telescoping steam boom is able to travel between an extended position and a retracted position; the retracted position useful for transport; the extended position such that the telescoping steam boom is able to occupy a location above the fire such that the water is able to be pressure sprayed on to the fire. The telescoping steam boom telescopes from 15 feet to 100 feet. The telescoping steam boom has 360 degree rotation. The telescoping steam boom has 45 degree elevation capability. The telescoping steam boom is insulated to protect the telescoping steam boom in case of electrical contact when penetrating a wall. The telescoping steam boom comprises an insulated tip. The telescoping steam boom comprises joints that move in relation to each other.

The at least one generator provides power to the fire suppressant system during an in-use condition. The at least one hose reel is structured and arranged to coil and uncoil hoses used to suppress and extinguish the fire. The at least one fuel storage compartment contains fuel useful for fueling the at least one once through boiler and the vehicle. The at least one hydraulic pump is provided to manipulate the telescoping steam boom during the in-use condition. The fire suppressant system is useful for remotely suppressing and extinguishing the fire by removing available oxygen via pressurized and atomized spray.

A kit is described herein including: the fire suppressant assembly for installation on a vehicle comprising the at least one water storage compartment, the at least one fuel storage compartment, the at least one once through boiler, the at least one hydraulic pump, the at least one generator, the at least one water pump, the at least one hose reel, the telescoping steam boom; and a set of installation instructions.

A method of using a fire suppressant system is also disclosed herein comprising the steps of: installing a fire suppressant assembly to a frame of a vehicle, filling at least one water storage compartment, filling at least one fuel storage compartment, running at least one generator, activating at least one once through boiler, operating at least one hydraulic pump to manipulate a telescoping steam boom, and pumping water via at least one water pump to extinguish a fire via applying pressurized steam to said fire. The method may further comprise the step of puncturing a wall using said telescoping steam boom using said at least one hydraulic pump.

The present invention holds significant improvements and serves as a fire suppressant system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, fire suppressant system, constructed and operative according to the teachings of the present invention.

The various embodiments of the present invention will hereinafter be described in conjunction with the appended drawings, wherein like designations denote like elements.

DETAILED DESCRIPTION

Figure 1:
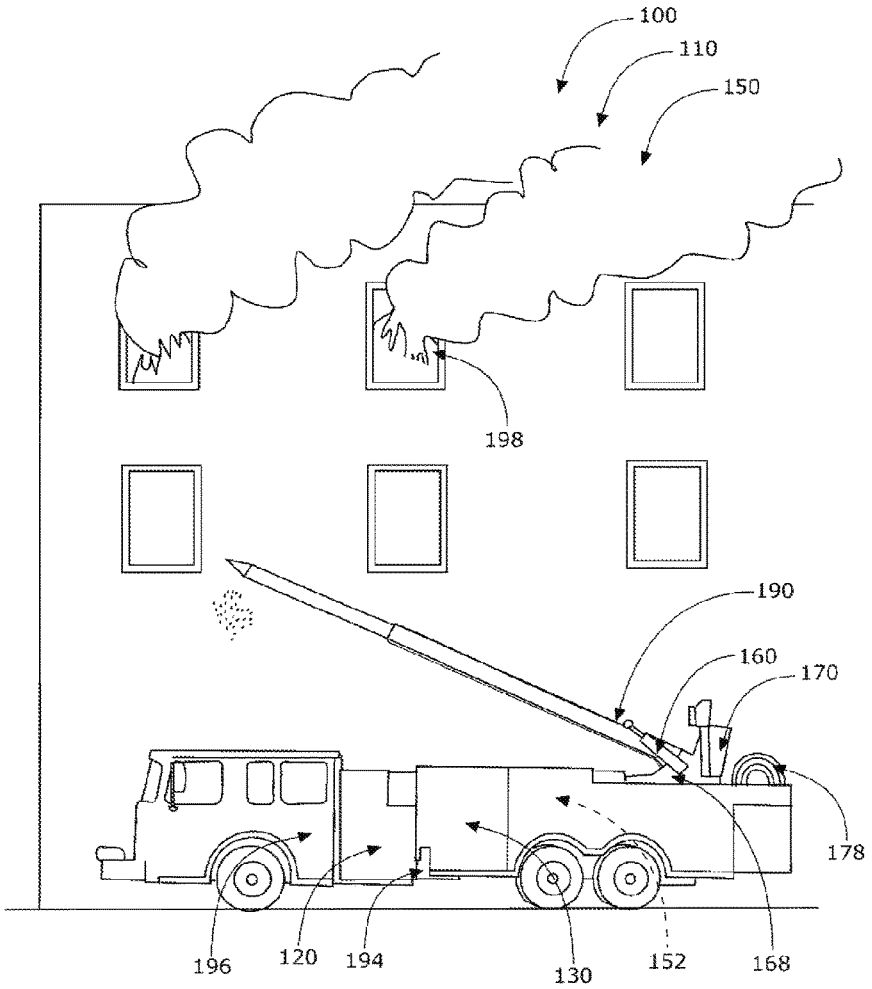
FIG. 1 shows a perspective view illustrating a fire suppressant system during an 'in-use' condition according to an embodiment of the present invention.
Figure 2:
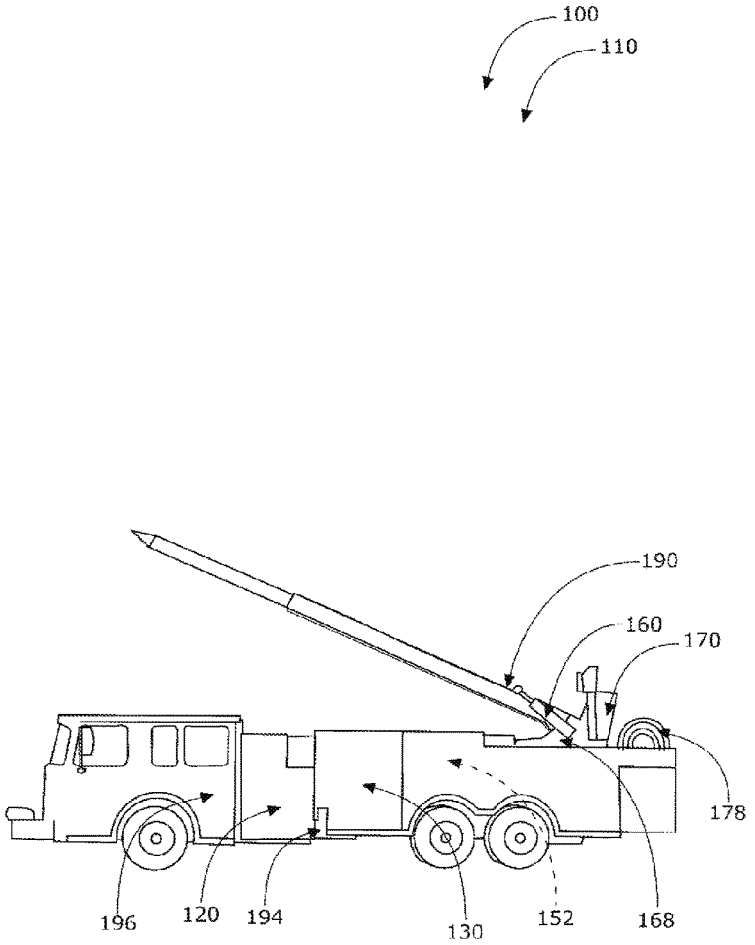
FIG. 2 is a perspective view illustrating the fire suppressant system comprising a telescoping steam boom according to an embodiment of the present invention of FIG. 1.
Figure 3:
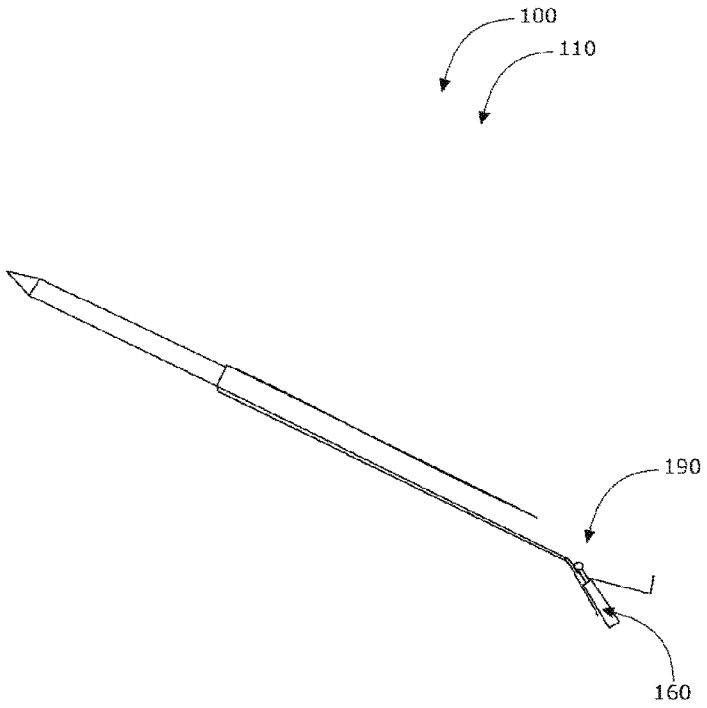
FIG. 3 is a perspective view illustrating the fire suppressant system comprising the telescoping steam boom according to an embodiment of the present invention of FIGS. 1-2.
Figure 4:
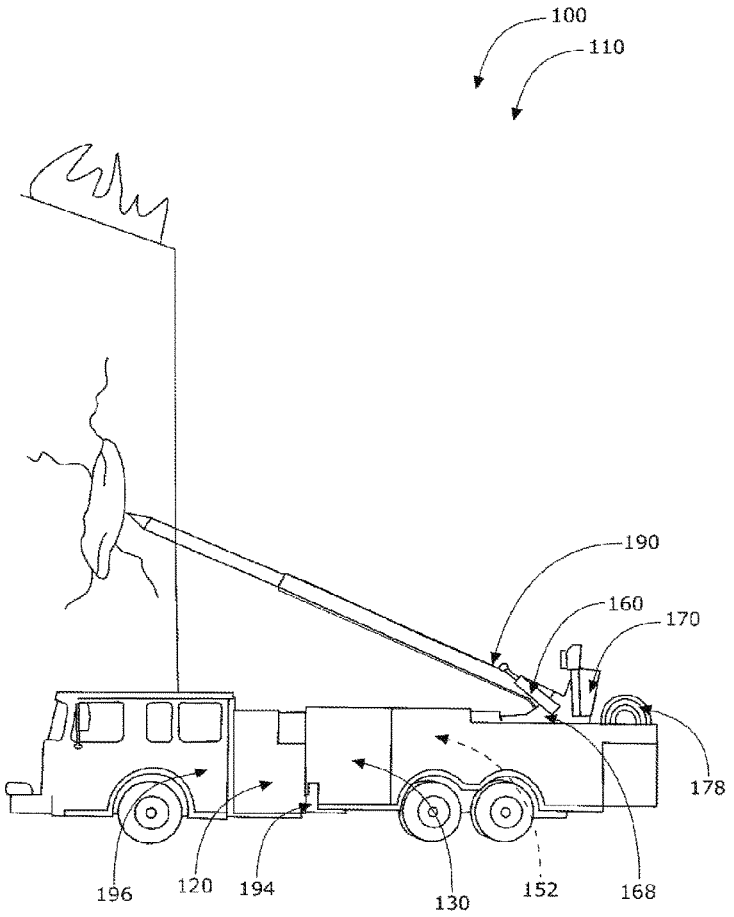
FIG. 4 is a perspective view illustrating the fire suppressant system comprising the telescoping steam boom with a penetrating tip according to an embodiment of the present invention of FIGS. 1-3.

As discussed above, embodiments of the present invention relate to a fire extinguisher and more particularly to a fire suppressant system as used to improve fire suppressing methods.

Generally speaking, the invention is a device that uses steam/super-heated water to suppress and put out fires rather than the traditional water method. The device comprises a once through boiler with no pressure vessels, it is not dependent on level operation and it could produce steam almost instantly. The invention uses steam/super-heated water under high pressure to blow out and suppress the fire. The wet pressurized steam/super-heated water "blows out" the fire and the pressure removes the oxygen and spark needed for the fire to continue burning. The wet steam/super-heated water works much like water to suppress and put out the fire but the additional benefits of the pressure help to reduce the fuel (air and spark) for the fire as well.

A pump may suction water from a storage tank. The water would be pumped through the once through boiler where it would be supper heated and delivered to a manifold. The manifold is equipped with up to three hose outlets and feed line directly connected to the steam boom.

In the initial stages of a structural fire, the steam boom may penetrate a door which would cause the least amount damage to the structure. The once through boiler may then deliver large amounts of steam (1 cu. ft. of water=approx. 2700 cu ft of steam) into the structure. With large amounts of steam being forced into the structure it may cause a small positive pressure in the structure thereby limiting air from coming into the structure to feed the fire. At the same time it would flood the structure with steam to suffocate the fire and cool the source of combustion. In the case of a totally engulfed structure steam may be applied to three sides of the structure. The steam blows out the fire and suffocates it by replacing the air. Also, the steam cloud would protect adjacent structures form the radiant heat of the fire The fire suppressant system comprises, a light weight telescoping boom, a telescoping from 15 to 100 ft. 360 degree rotation and a 45 degree elevation, double walled for insulation, and a hydraulic operated penetrating insulated tip insulated from the boom to protect the boom in case of electrical contact when penetrating a wall.

Referring to the drawings by numerals of reference there is shown in FIGS. 1-4, fire suppressant system 100 comprising fire suppressant assembly 110 having at least one water storage compartment 120, at least one fuel storage compartment 130, at least one once through boiler 152, at least one hydraulic pump 160, at least one generator 168, at least one water pump 170, at least one hose reel 178, and telescoping steam boom 190. Fire suppressant system 100 is mounted to vehicle frame 194. Vehicle 196 is movable between locations. At least one once through boiler 152 heats water delivered from an inner volume of at least one water storage compartment 120. At least one water pump 170 pumps water from at least one once through boiler 152 through telescoping steam boom 190, water used to suppress and extinguish a fire 198.

Telescoping steam boom 190 is able to travel between extended position and a retracted position. The retracted position useful for transport. The extended position is such that telescoping steam boom 190 is able to occupy location above fire 198 such that water is able to be pressure sprayed on to fire 198. At least one generator 168 provides power to fire suppressant system 100 during an in-use condition. At least one hose reel 178 is structured and arranged to coil and uncoil hoses used to suppress and extinguish fire 198. At least one fuel storage 130 compartment contains fuel useful for fueling at least one once through boiler 152 and vehicle 196. At least one hydraulic pump 160 is provided to manipulate telescoping steam boom 190 during in-use condition 150. Fire suppressant system 100 is useful for remotely suppressing and extinguishing fire 198 by removing available oxygen via pressurized and atomized spray.

At least one water storage compartment 120 has a capacity 2000 gallons of water (smaller and larger versions may be used). At least one fuel storage compartment 130 has a capacity of 1200 gallons of fuel to provide sustained fire-fighting ability over a duration (smaller and larger versions may be used). Telescoping steam boom 190 is double-walled to be fire resistant. At least one once through boiler 152 provides heat elevation means to vaporize water to suppress and extinguish fire 198. At least one hydraulic pump 160 converts mechanical power into hydraulic energy for extending and retracting telescoping steam boom 190. At least one water pump 170 creates a vacuum at a pump-inlet, which forces water from at least one once through boiler 152 into an inlet line of at least one water pump 170 and by mechanical action delivers water to pump-outlet of at least one water pump 170 to be delivered. Water is super-heated under high-pressure to achieve the desired results.

Telescoping steam boom 190 telescopes from 15 feet to 100 feet (smaller and larger versions may be used). Telescoping steam boom 190 has 360 degree rotation. Telescoping steam boom 190 has 45 degree elevation capability. At least one water storage compartment 120 is able to hold at least one fire-suppressant liquid. Telescoping steam boom is 190 insulated to protect said telescoping steam boom in case of electrical contact when penetrating a wall. Telescoping steam boom 190 comprises an insulated tip. Telescoping steam boom 190 comprises joints that move in relation to each other.

Fire suppressant system 100 may be sold as kit 440 for installation as a retro-fit or OEM comprising the following parts: fire suppressant assembly for installation on a vehicle having 112; at least one water storage compartment 120; at least one fuel storage compartment 130; at least one once through boiler; at least one hydraulic pump 160; at least one generator 168; at least one water pump 170; at least one hose reel 178; telescoping steam boom 190; and at least one set of installation instructions 442. The kit 440 may further comprise any necessary mounting hardware. The kit has instructions 442 such that functional relationships are detailed in relation to the structure of the invention (such that the invention can be used, maintained, or the like in a preferred manner). Fire suppressant system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different powering/pumping combinations, parts may be sold separately, etc., may be sufficient.

Figure 5:
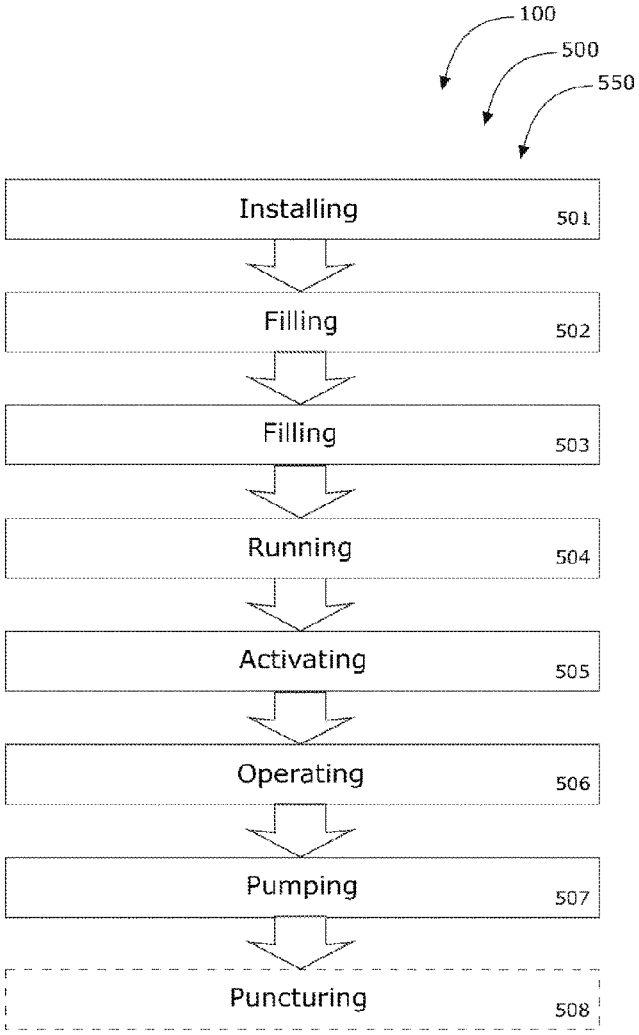
FIG. 5 is a flowchart illustrating a method of use for the fire suppressant system according to an embodiment of the present invention of FIGS. 1-4.

Referring now to FIG. 5 showing flowchart 550 illustrating method of use 500 for fire suppressant system 100 according to an embodiment of the present invention of FIGS. 1-4.

As shown, method of use 500 may comprise the steps of: step one 501, installing a fire suppressant assembly to a frame of a vehicle; step two 502, filling at least one water storage compartment; step three 503, filling at least one fuel storage compartment; step four 504, running at least one generator; step five 505, activating at least one once through boiler; step six 506, operating at least one hydraulic pump to manipulate a telescoping steam boom; step seven 507, pumping water via at least one water pump to extinguish a fire via applying pressurized steam to said fire; and step eight 508, puncturing a wall using said telescoping steam boom using said at least one hydraulic pump.

It should be noted that step eight 508 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A fire suppressant system comprising:

a fire suppressant assembly comprising;

at least one water storage compartment;

at least one fuel storage compartment;

at least one once through boiler;

at least one hydraulic pump;

at least one generator;

at least one water pump;

at least one hose reel; and a telescoping steam boom;

wherein said fire suppressant system comprises said fire suppressant assembly;

wherein said fire suppressant system is mounted to a vehicle frame of a vehicle;

wherein said fire suppressant assembly comprises in functional combination said at least one water storage compartment, said at least one fuel storage compartment, said at least one once through boiler, said at least one hydraulic pump, said at least one generator, said at least one water pump, said at least one hose reel, and said telescoping steam boom;

wherein said vehicle is movable between locations;

wherein said at least one once through boiler heats water delivered from an inner volume of said at least one water storage compartment;

wherein said at least one water pump pumps said water from said at least one once through boiler through said telescoping steam boom, said water used to suppress and extinguish a fire;

wherein said telescoping steam boom is able to travel between an extended position and a retracted position, said retracted position useful for transport, said extended position such that said telescoping steam boom is able to occupy a location above said fire such that said water is able to be pressure sprayed on to said fire;

wherein said at least one generator provides power to said fire suppressant system during an in-use condition;

wherein said at least one hose reel is structured and arranged to coil and uncoil hoses used to suppress and extinguish said fire;

wherein said at least one fuel storage compartment contains fuel useful for fueling said at least one once through boiler and said vehicle;

wherein said at least one hydraulic pump is provided to manipulate said telescoping steam boom during said in-use condition; and wherein said fire suppressant system is useful for remotely suppressing and extinguishing said fire by removing available oxygen via pressurized and atomized spray.

2. The fire suppressant system of claim 1 wherein said at least one water storage compartment has a capacity of 2000 gallons of said water.

3. The fire suppressant system of claim 1 wherein said at least one fuel storage compartment has a capacity of 1200 gallons of said fuel to provide sustained fire-fighting ability over a duration.

4. The fire suppressant system of claim 1 wherein said telescoping steam boom is double-walled.

5. The fire suppressant system of claim 4 wherein said telescoping steam boom is double-walled to be fire resistant.

6. The fire suppressant system of claim 1 wherein said at least one once through boiler provides heat elevation means to vaporize said water to suppress and extinguish said fire.

7. The fire suppressant system of claim 1 wherein said at least one hydraulic pump converts mechanical power into hydraulic energy for extending and retracting said telescoping steam boom.

8. The fire suppressant system of claim 7 wherein said at least one water pump creates a vacuum at a pump-inlet, which forces said water from said at least one once through boiler into an inlet line of said at least one water pump and by mechanical action delivers said water to a pump-outlet of said at least one water pump to be delivered.

9. The fire suppressant system of claim 1 wherein said telescoping steam boom telescopes from 15 feet to 100 feet.

10. The fire suppressant system of claim 1 wherein said telescoping steam boom has 360 degree rotation.

11. The fire suppressant system of claim 1 wherein said telescoping steam boom has 45 degree elevation capability.

12. The fire suppressant system of claim 1 wherein said at least one water storage compartment is able to hold at least one fire-suppressant liquid.

13. The fire suppressant system of claim 1 wherein said telescoping steam boom is insulated to protect said telescoping steam boom in case of electrical contact when penetrating a wall.

14. The fire suppressant system of claim 1 wherein said telescoping steam boom comprises an insulated tip.

15. The fire suppressant system of claim 1 wherein said telescoping steam boom comprises joints that move in relation to each other.

16. The fire suppressant system of claim 1 wherein said water is super-heated under high-pressure.

17. A fire suppressant system comprising:

a fire suppressant assembly comprising;

at least one water storage compartment;

at least one fuel storage compartment;

at least one once through boiler;

at least one hydraulic pump;

at least one generator;

at least one water pump;

at least one hose reel;

a manifold; and a telescoping steam boom;

wherein said fire suppressant system comprises said fire suppressant assembly;

wherein said fire suppressant system is mounted to a vehicle frame of a vehicle;

wherein said fire suppressant assembly comprises in functional combination said at least one water storage compartment, said at least one fuel storage compartment, said at least one once through boiler, said at least one hydraulic pump, said at least one generator, said at least one water pump, said at least one hose reel, said manifold, and said telescoping steam boom;

wherein said at least one hydraulic pump converts mechanical power into hydraulic energy for extending and retracting said telescoping steam boom;

wherein said manifold is in communication with said telescoping steam boom;

wherein said at least one water pump creates a vacuum at a pump-inlet, which forces said water from said at least one once through boiler into an inlet line of said at least one water pump and by mechanical action delivers said water to a pump-outlet of said at least one water pump to be delivered;

wherein said at least one water storage compartment has a capacity of 2000 gallons of said water;

wherein said at least one water storage compartment is able to hold at least one fire-suppressant liquid;

wherein said at least one fuel storage compartment has a capacity of 1200 gallons of said fuel to provide sustained fire-fighting ability over a duration;

wherein said vehicle is movable between locations;

wherein said at least one once through boiler heats water delivered from an inner volume of said at least one water storage compartment;

wherein said at least one once through boiler provides heat elevation means to vaporize said water to suppress and extinguish said fire;

wherein said at least one water pump pumps said water from said at least one once through boiler through said telescoping steam boom, said water used to suppress and extinguish a fire;

wherein said water is super-heated under high-pressure;

wherein said telescoping steam boom is double-walled;

wherein said telescoping steam boom is double-walled to be fire resistant;

wherein said telescoping steam boom is able to travel between an extended position and a retracted position, said retracted position useful for transport, said extended position such that said telescoping steam boom is able to occupy a location above said fire such that said water is able to be pressure sprayed on to said fire;

wherein said telescoping steam boom telescopes from 15 feet to 100 feet;

wherein said telescoping steam boom has 360 degree rotation;

wherein said telescoping steam boom has 45 degree elevation capability;

wherein said telescoping steam boom is insulated to protect said telescoping steam boom in case of electrical contact when penetrating a wall;

wherein said telescoping steam boom comprises an insulated tip;

wherein said telescoping steam boom comprises joints that move in relation to each other;

wherein said at least one generator provides power to said fire suppressant system during an in-use condition;

wherein said at least one hose reel is structured and arranged to coil and uncoil hoses used to suppress and extinguish said fire;

wherein said at least one fuel storage compartment contains fuel useful for fueling said at least one once through boiler and said vehicle;

wherein said at least one hydraulic pump is provided to manipulate said telescoping steam boom during said in-use condition; and wherein said fire suppressant system is useful for remotely suppressing and extinguishing said fire by removing available oxygen via pressurized and atomized spray.

18. The fire suppressant system of claim 17 further comprising a kit including:

said fire suppressant assembly for installation on a vehicle comprising;

said at least one water storage compartment;

said at least one fuel storage compartment;

said at least one once through boiler;

said at least one hydraulic pump;

said at least one generator;

said at least one water pump;

said at least one hose reel;

said telescoping steam boom; and a set of installation instructions.

19. A method of using a fire suppressant system comprising the steps of:

installing a fire suppressant assembly to a frame of a vehicle;

filling at least one water storage compartment;

filling at least one fuel storage compartment;

running at least one generator;

activating at least one once through boiler;

operating at least one hydraulic pump to manipulate a telescoping steam boom; and pumping water via at least one water pump to extinguish a fire via applying pressurized steam to said fire.

20. The method of claim 19 further comprising the step of:

puncturing a wall using said telescoping steam boom using said at least one hydraulic pump.

* * * * *